US006595460B1

(12) United States Patent
Jones

(10) Patent No.: US 6,595,460 B1
(45) Date of Patent: Jul. 22, 2003

(54) WEB MATERIAL ALIGNMENT APPARATUS AND METHOD

(75) Inventor: Bobby Grant Jones, Huntsville, AL (US)

(73) Assignee: Innovative Solutions, Inc., Owens Crossroads, AL (US)

( * ) Notice: Subject to any disclaimer, the term of this patent is extended or adjusted under 35 U.S.C. 154(b) by 0 days.

(21) Appl. No.: 09/934,442

(22) Filed: Aug. 21, 2001

Related U.S. Application Data

(60) Provisional application No. 60/227,083, filed on Aug. 22, 2000, now abandoned.

(51) Int. Cl.[7] ..... B65H 18/08; B65H 43/08; G01C 15/00; G01D 21/00

(52) U.S. Cl. ..... 242/538.2; 33/286; 33/623; 33/DIG. 21; 242/533.7; 242/534.1; 242/563.1

(58) Field of Search ..... 242/563.1, 563, 242/534.1, 538.2, 532.7; 226/20, 91; 33/286, 623, DIG. 21

(56) References Cited

U.S. PATENT DOCUMENTS 3,232,547 A * 2/1966 Theide et al. ..... 242/563.1
4,021,031 A * 5/1977 Meihofer et al. ..... 226/20
4,077,579 A * 3/1978 Seleski et al. ..... 242/563.1
4,106,715 A * 8/1978 Pisani ..... 226/20
4,123,148 A 10/1978 Laird
4,500,045 A * 2/1985 Whitaker et al. ..... 226/20
4,543,152 A * 9/1985 Nozaka ..... 242/563.1
5,488,781 A * 2/1996 Van Der Horst ..... 33/286
5,489,784 A * 2/1996 Koiranen et al. ..... 226/20
5,689,545 A 11/1997 Hopkins
5,741,096 A 4/1998 Olds
5,778,724 A 7/1998 Clapp et al.
5,796,418 A 8/1998 Silverbrook
5,881,965 A * 3/1999 Doell et al. ..... 242/563.1
5,956,065 A 9/1999 Van den Wijngaert et al.
5,992,986 A 11/1999 Gyotoku et al.
6,012,799 A 1/2000 Silverbrook
6,031,616 A 2/2000 Seiffert
6,069,748 A 5/2000 Bietry
6,174,095 B1 1/2001 Desie et al.

* cited by examiner

*Primary Examiner*—Michael R. Mansen
(74) *Attorney, Agent, or Firm*—Lanier Ford Shaver & Payne P.C.

(57) ABSTRACT

A method of aligning the edge of an elongated printable media on the web handling assembly of a printer is disclosed. The method includes the steps of projecting an alignment marker onto at least a portion of the web handling assembly, passing the elongated printable media through the web handling assembly, and aligning the edge of the elongated printable media with the alignment marker such that the edge is substantially co-linear with the alignment marker. An apparatus for aligning an elongated printable media on the web handling assembly of a printer is also disclosed.

7 Claims, 6 Drawing Sheets

WEB MATERIAL ALIGNMENT APPARATUS AND METHOD

CROSS REFERENCE TO RELATED APPLICATIONS

This application claims the benefit of U.S. Provisional Application No. 60/227,083, filed Aug. 22, 2000, now abandoned, which is hereby incorporated by reference herein.

BACKGROUND OF THE INVENTION

1. Field of the Invention

The present invention relates generally to the field of large format printing, and more particularly to an apparatus and method for aligning an image receiving substrate material on the web handling assembly of a large format printer.

2. Technical Background

There are several systems commercially available today that employ a plurality of piezoelectric print heads to transfer ink to a large scale image receiving substrate or web material to produce graphic products with multicolored or enhanced graphic images for signs, large banners, billboards, and the like. The web material used in such systems is typically supplied in a roll and is typically constructed of vinyl, some other polymeric material, or specialty paper. Generally speaking a computer system is employed to format a selected graphic target image such that it can be reproduced in the desired enlarged size and location on the web material by the piezoelectric print heads as the web material is advanced through a plurality of rollers in the printer. A carriage housing the piezoelectric print heads is typically moved across the web material at a controlled rate of speed while ink is delivered from the heads to the web material. Generally speaking the ink is typically delivered during a number of passes across the web material so that the graphic image created on the web material resembles the target image entered in the computer as closely as possible.

Printing with such commercially available systems is extremely difficult and time consuming. Because such systems generally deliver only four colors of ink, preferably, cyan, magenta, yellow, and black, reproducing an acceptable likeness of the target image requires precise synchronization of the web advancement and ink delivery. Any misalignment of the web material, change in the advancement rate of the web material, clogging of the print heads, misfires of the ink jet nozzles, improper impact of the ink droplets on the web material, or other misstep in the process can result in poor color quality, improper shading, an effect commonly known in the art as "banding", poor resolution, or other defect in the graphic image transferred to the web material. Moreover, because the graphic image transferred to the web material occupies such a large surface area, small mistakes in the process are magnified and are generally readily apparent to the naked eye.

An important aspect of large format printing is the alignment of the web material with respect to the print heads. If the web material, which is generally supplied in a roll having a diameter of up to approximately 16 inches, is not properly loaded into the printer, any initial misalignment, however small, will result in a significant shift in alignment of the web material as the web material approaches the end of the roll. This phenomena, known as "walking" will significantly impact printing quality, and if severe enough, can inhibit printing altogether. In most commercially available large format printers, loading of the web material is still a manual process and requires an operator to advance the web material several meters in a dry run to determine if the web material walks. Others have attempted to position reference marks on the web material rollers to facilitate proper alignment during loading, but this approach has had little success as the web material cores often cover the reference marks or the reference marks become inadvertently covered with ink so that they are no longer visible after a relatively short period of time. As a result, determining whether the web material is loaded square or straight in the printer has been a difficult task.

What is needed therefore, but currently unavailable in the art, is an improved large format printer incorporating an alignment apparatus and method for facilitating proper loading of web material onto the web handling assembly rollers of the printer. The apparatus and method should be easy to maintain, provide quick and accurate web material alignment, and facilitate proper incremental advancement of the web material during printing operations. Moreover, such a device should facilitate efficient loading and unloading of web material rolls and provide large format graphic images of higher resolution and clarity than other large format printers known in the art, while at the same time increasing print speeds. The alignment apparatus should also be inexpensive to manufacture and maintain and should be efficient in operation. It is to the provision of such an apparatus and method that the present invention is primarily directed.

SUMMARY OF THE INVENTION

Accordingly, one aspect of the present invention relates to a method of aligning the edge of an elongated printable media on the web handling assembly of a printer. The method includes the steps of projecting an alignment marker onto at least a portion of the web handling assembly, passing the elongated printable media through the web handling assembly, and aligning the edge of the elongated printable media with the alignment marker so that the edge is substantially co-linear with the alignment marker.

In another aspect of the present invention is directed to an elongated printable media alignment apparatus for aligning the elongated printable media on the web handling assembly of a printer. The apparatus includes a light source constructed and arranged to project a substantially linear alignment marker onto at least a portion of the web handling assembly, and an adjustable support structure for securing a light source to the printer such that the light source is sufficiently remote from the printer.

An additional aspect of the present invention relates to a method of aligning an edge of an elongated printable media on a printer web handling assembly incorporating a supply roller and take-up roller. The method includes the steps of loading a roll of elongated printable media onto the supply roller, projecting an alignment marker onto at least a portion of the web handling assembly, and moving the roll of elongated printable media toward the alignment marker to align the edge of the media with the alignment marker. The elongated printable media is extracted from the roll to pass the elongated printable media through the web handling assembly, and the edge of the elongated printable media is aligned with the alignment marker as the elongated printable media is brought into engagement with the take-up roller. Once the edge of the elongated printable media is aligned with the alignment marker, the elongated printable media is secured to the take-up roller.

The web material alignment apparatus and method of the present invention results in a number of advantages over other grand format printers and methods of printing large scale graphics commonly known in the art. For example, the web material alignment apparatus of the present invention significantly reduces web material misalignments during web material loading. In addition, the present invention obviates the need for complex and inaccurate web material and alignment procedures and facilitates the rapid loading and unloading of web material rolls.

In addition to the advantages set forth above, the web material alignment apparatus and method of the present invention significantly reduces the occurrence of web material wrinkling during web advancement and printing operations. Moreover, web material "walking" on the take-up roller during web advancement and printing is substantially prevented. As a result, far less time is spent repeating the same print job using the improved grand format printer of the present invention.

Additional features and advantages of the present invention will be set forth in the detailed description which follows, and in part will be readily apparent to those skilled in the art from the description or recognized by practicing the invention as described herein.

It is to be understood that both the foregoing general description and the following detailed description are merely exemplary of the invention and are intended to provide an overview or framework for understanding the nature and character of the invention as it is claimed. The accompanying drawings are included to provide further understanding of the invention, illustrate various embodiments in the invention, and together with the description serve to explain the principles and operation of the invention.

DETAILED DESCRIPTION

Figure 1:
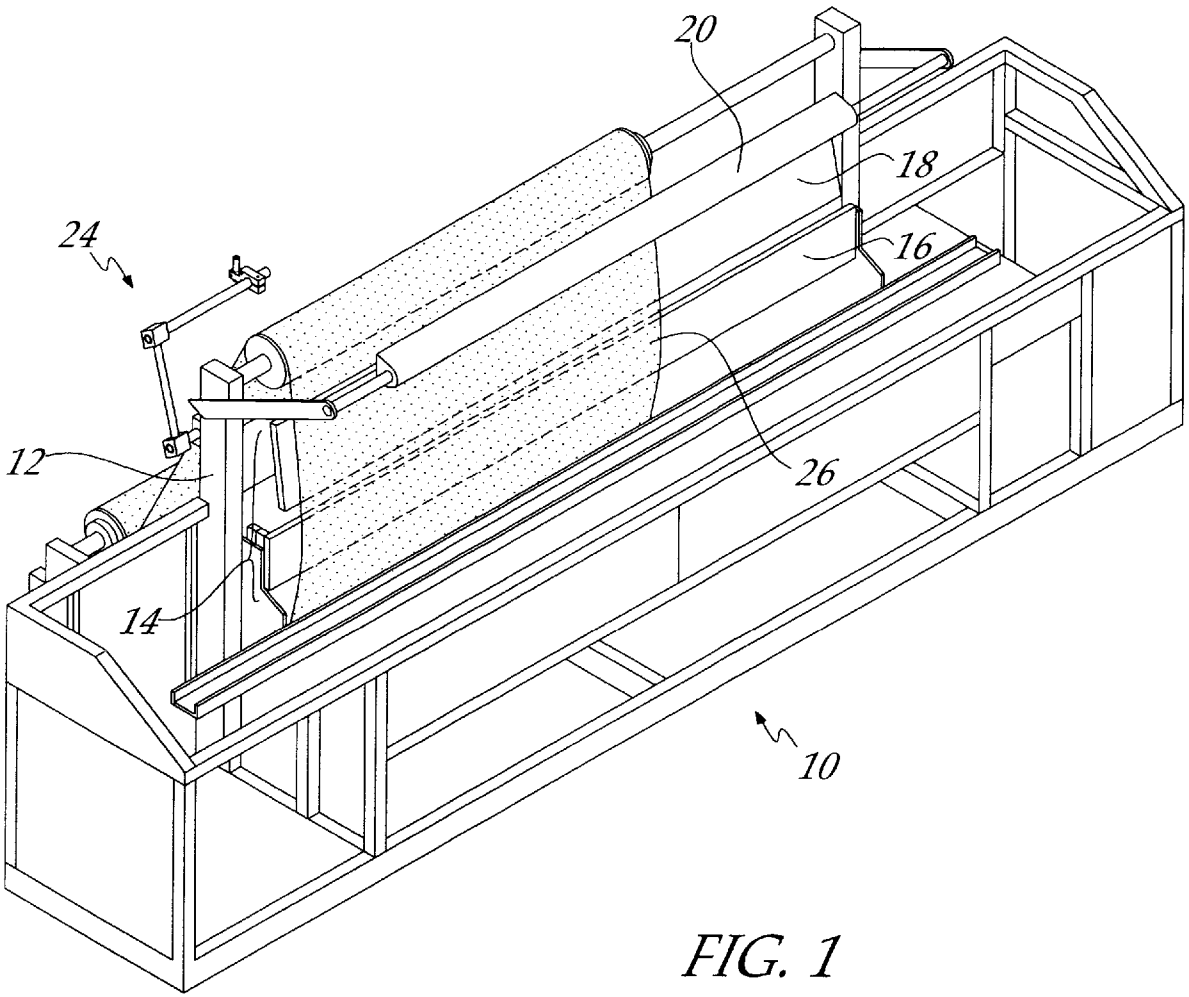
FIG. 1 is a front perspective view of an improved grand format printer in accordance with the present invention.

Reference will now be made in detail to the present preferred embodiments of the invention, examples of which are illustrated in the accompanying drawing figures. Wherever possible, the same reference characters will be used throughout the drawings to refer to the same or like parts. An exemplary embodiment of the improved grand format printer of the present invention is shown in FIG. 1, and is designated generally throughout by reference numeral 10.

Figure 2:
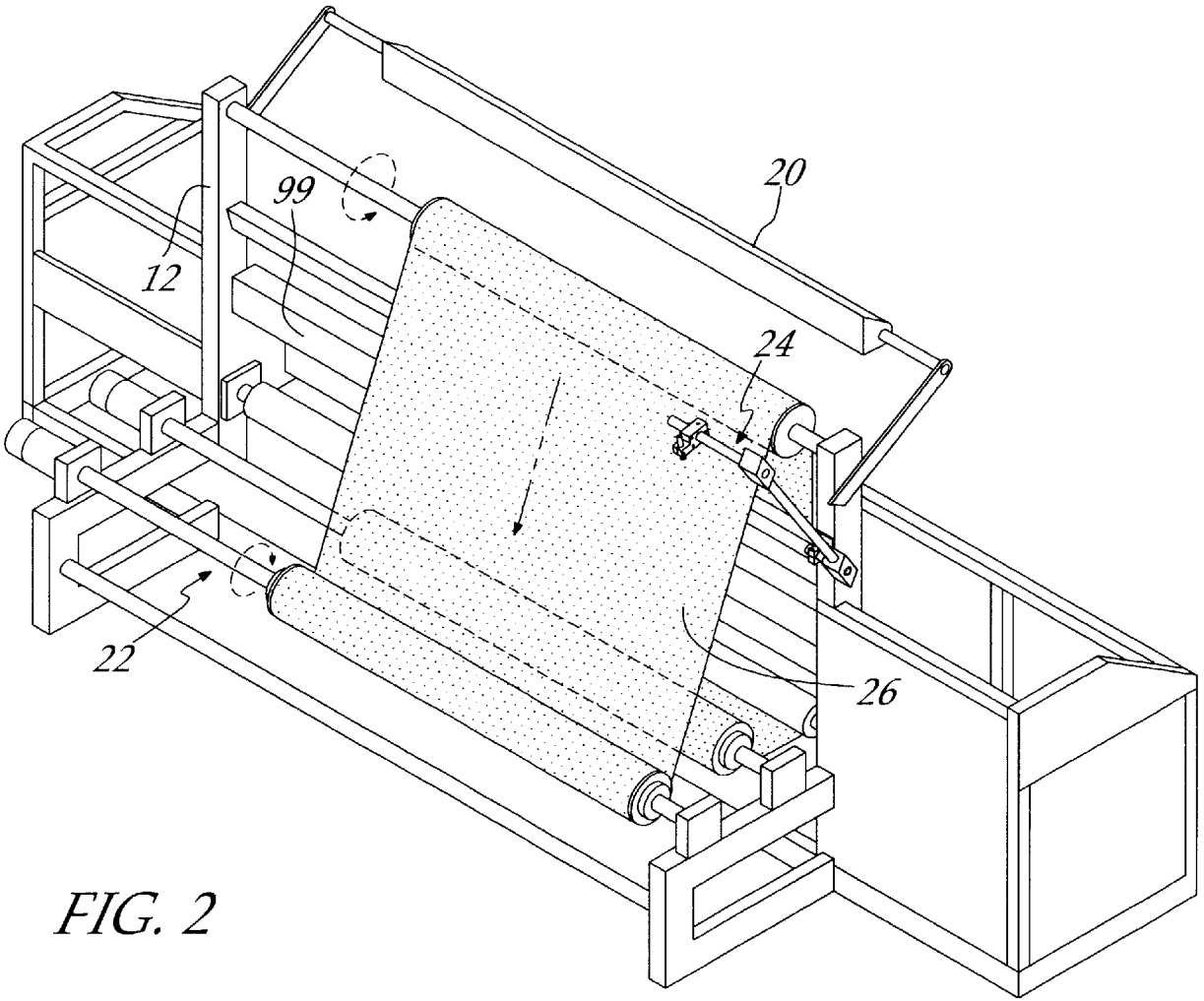
FIG. 2 is a rear perspective view of the improved grand format printer depicted in FIG. 1.

In accordance with the invention and as shown in FIG. 1, improved grand format printer 10 is preferably supported by a frame 12 preferably constructed of tubular metal and having welded connections. Broadly speaking, improved grand format printer 10 incorporates an ink delivery system (not shown), a data processing system (not shown), a heating zone 14 including a web material pre-heating platen 16 and an ink drying heater such as dry heater 18, and a lighting system 20. Improved grand format printer 10 may also preferably include a color management system (not shown), which among other things, minimizes banding and otherwise improves the resolution and quality of a graphic image transferred to a web material by the ink delivery system (not shown). In addition, and as depicted in FIG. 2, improved grand format printer 10 preferably includes a web handling assembly 22 and a web material alignment assembly 24, which, among other things, facilitates accurate alignment of a web material 26 within improved grand format printer 10 during web loading. As used herein, "web handling assembly 22" includes, but is not limited to, a supply roller, redirect roller, a directional roller, and a take-up roller, among other things. Each of the above-mentioned systems and assemblies cooperate to permit the expedient and efficient printing of large format graphics onto web material 26 being fed through improved grand format printer 10.

Figure 3:
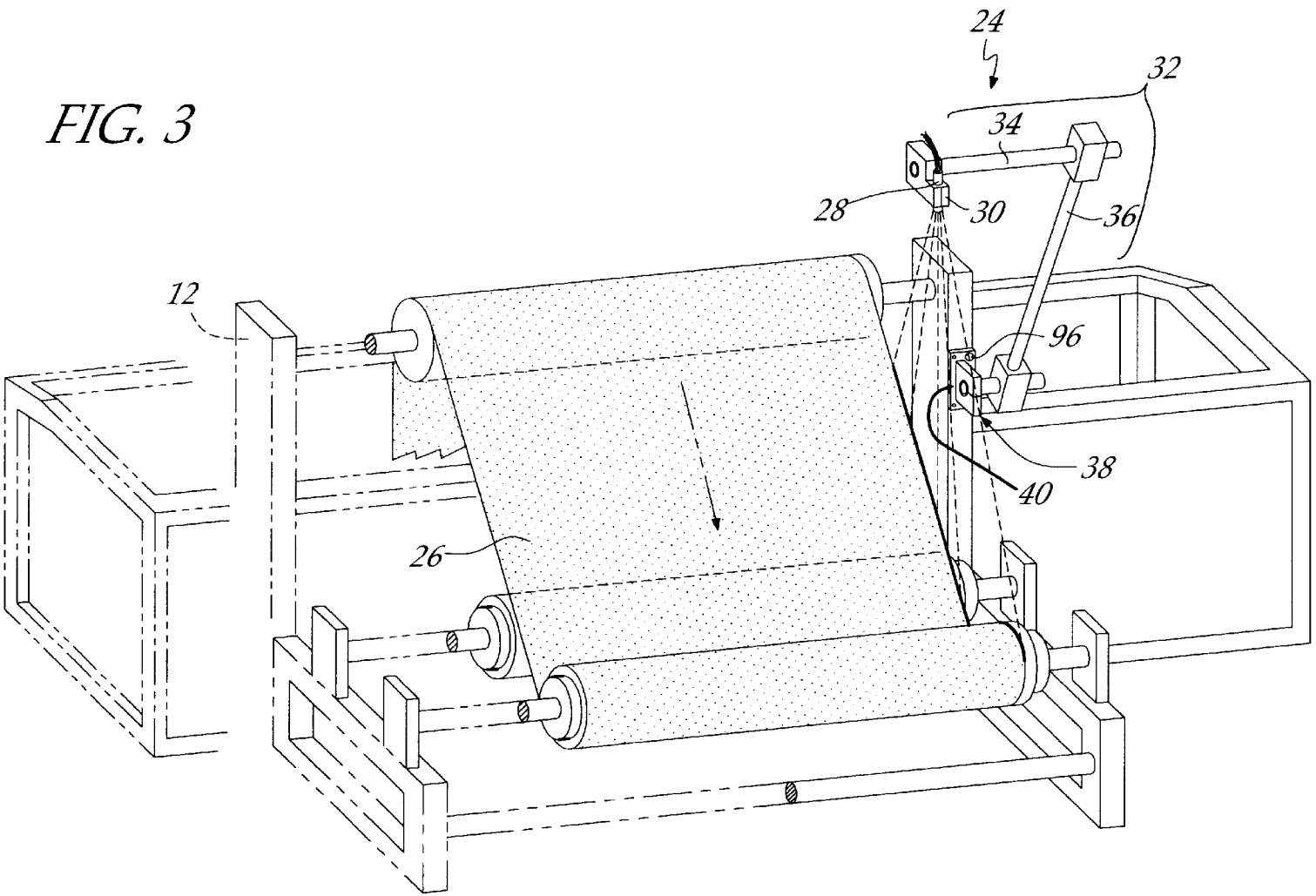
FIG. 3 is a detailed perspective view of a preferred web material alignment assembly taken from the rear of the improved grand format printer of the present invention with certain portions of the improved grand format printer being shown using phantom lines for the sake of clarity.

As depicted in FIG. 3, web material alignment assembly 24 preferably includes a laser line generator 28 which may be supported within a first mounting block 30, removably attached to a support frame 32. Although support frame 32 may be constructed from any rigid material and may take on any number of shapes, support frame 32 is preferably constructed from aluminum or some other light weight metal. In addition, support frame 32 preferably includes a substantially horizontal support arm 34 connected to a substantially upright support arm 36 at a joint. Although not critical to the operation of the present invention, horizontal support arm 34 is preferably joined with upright support arm 36 such that the support arms form a substantially right angle. The end of upright support arm 36 remote from horizontal support arm 34 is preferably supported within a pivot assembly 38, which is fastened to a second mounting block 40, which may be affixed to frame 12 or some other portion of improved grand format printer 10.

Figure 4:
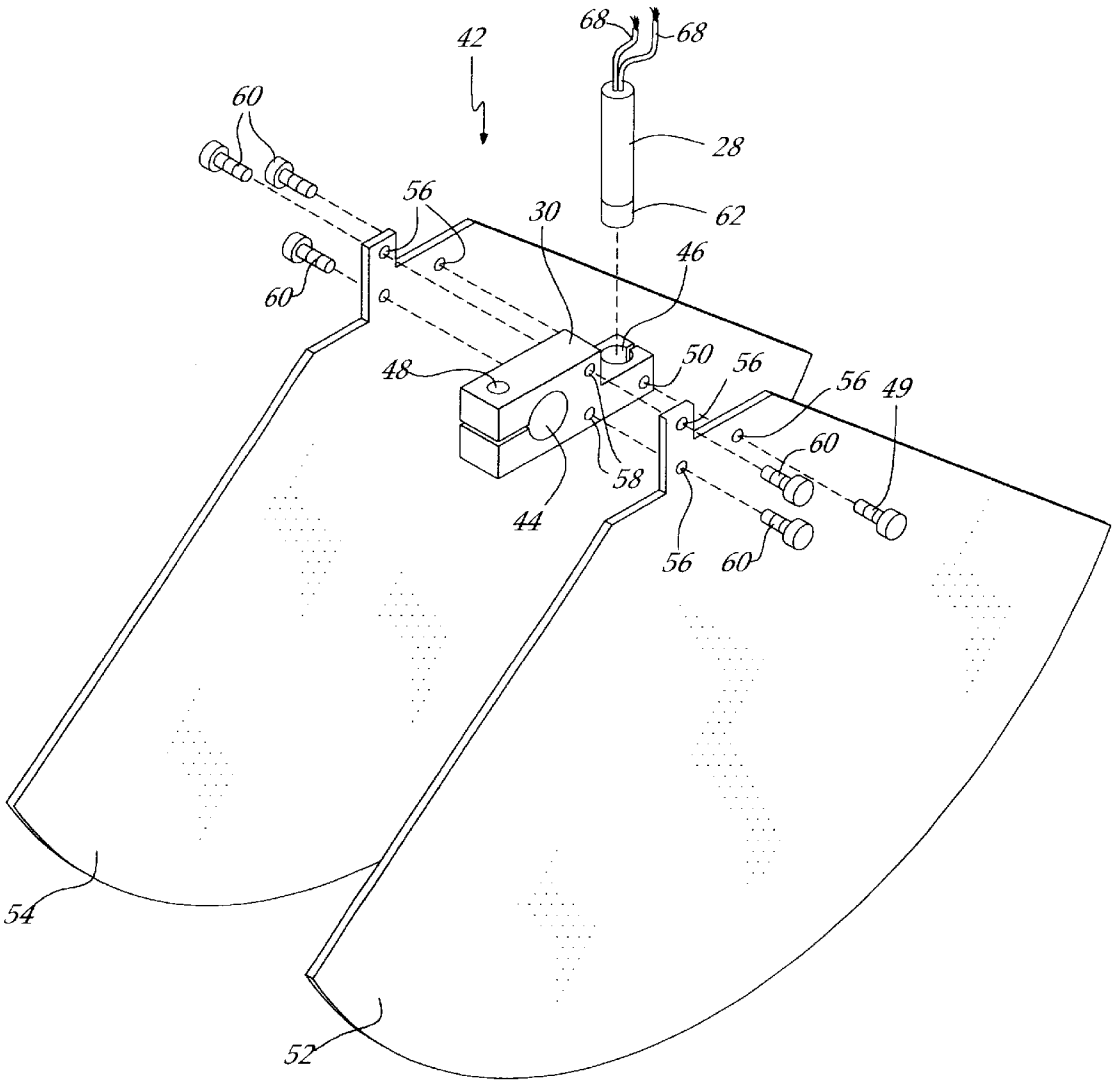
FIG. 4 is an exploded perspective view of a preferred laser assembly in accordance with the present invention.

A preferred laser assembly 42 in accordance with the present invention can be more clearly described with reference to the exploded perspective view depicted in FIG. 4. In accordance with a preferred embodiment of the present invention, first mounting block 30 is preferably constructed to include a horizontal support arm aperture 44 for axially receiving horizontal support arm 34, and a laser mounting bore 46 for axially receiving a laser line generator 28. As preferably arranged, horizontal support arm 34 and laser line generator 28 are received within their respective aperture and mounting bore in directions substantially orthogonal to one another. First mounting block 30 may be secured to horizontal support arm 34 by reducing the diameter of horizontal support arm aperture 44 by, for example, tightening a screw (not shown) within horizontal support arm adjustment aperture 48 in order to prevent rotation of first mounting block 30 on horizontal support arm 34. Likewise, the diameter of laser mounting bore 46 can be controlled by tightening or loosening a screw 49 within laser adjustment bore 50 to fixedly secure laser line generator 28 within first mounting block 30.

In a preferred embodiment, first mounting block 30 is preferably fitted with a front shield 52 and a rear shield 54, which, among other things, prevents an individual from moving closer than a distance of 20 cm from the laser aperture of laser line generator 28, as required by governmental regulations. As shown in FIG. 4, each shield 52 and 54 may be secured along the sides of first mounting block 30 by aligning shield apertures 56 with laser adjustment bore 50 and mounting block bores 58 located on the side of first mounting block 30. Screws 60 or other fasteners may then be passed through shield apertures 56 and threadably received within mounting block bores 58 to fixedly secure front shield 52 and rear shield 54 to the sides of mounting block 30. As will be recognized by one of ordinary skill in the art, screw 49 received within laser adjustment bore 50 serves the purpose of controlling the diameter size of laser mounting bore 46.

Figure 5:
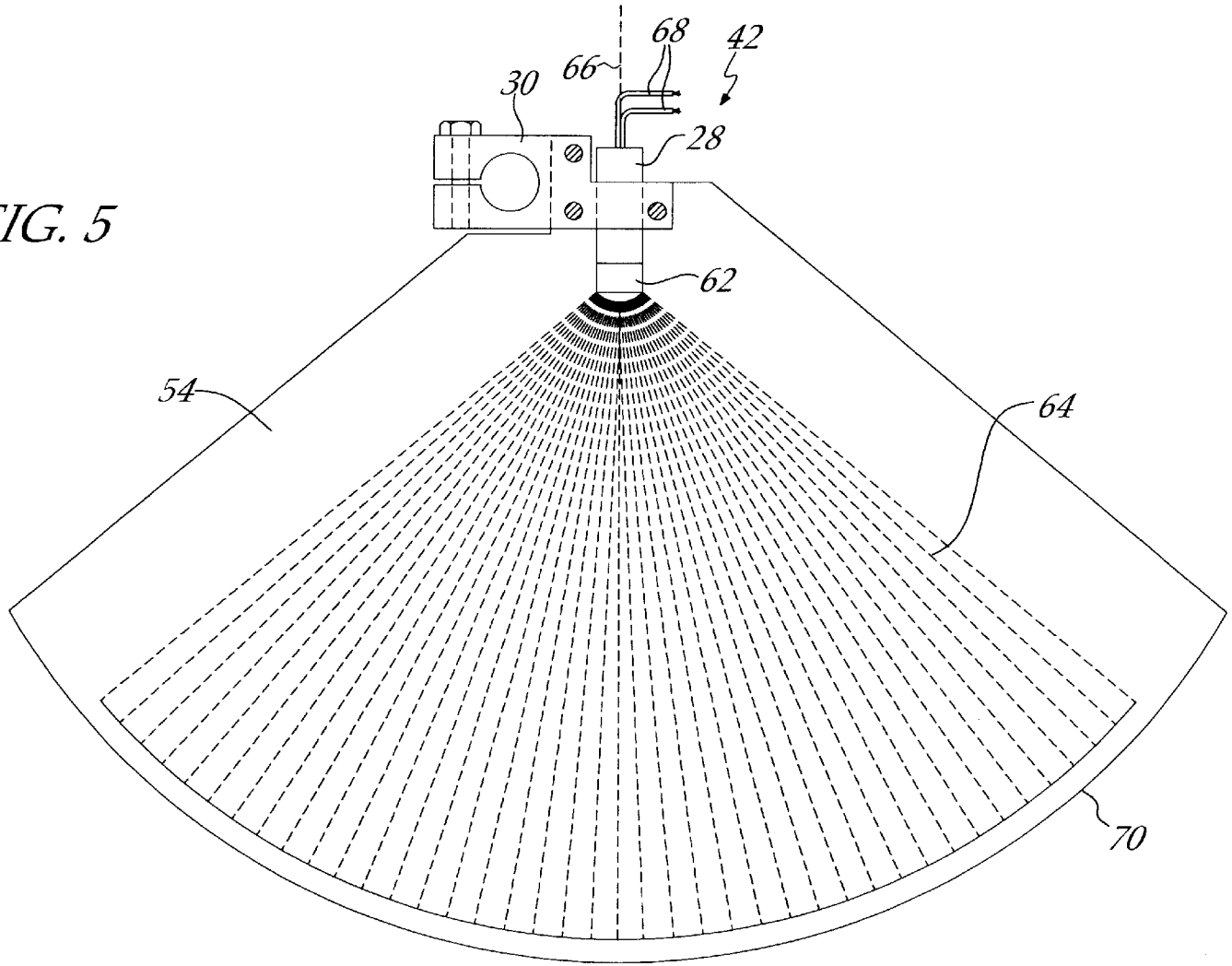
FIG. 5 is a side elevational view of the laser assembly depicted in FIG. 4 with the front shield removed.
Figure 6:
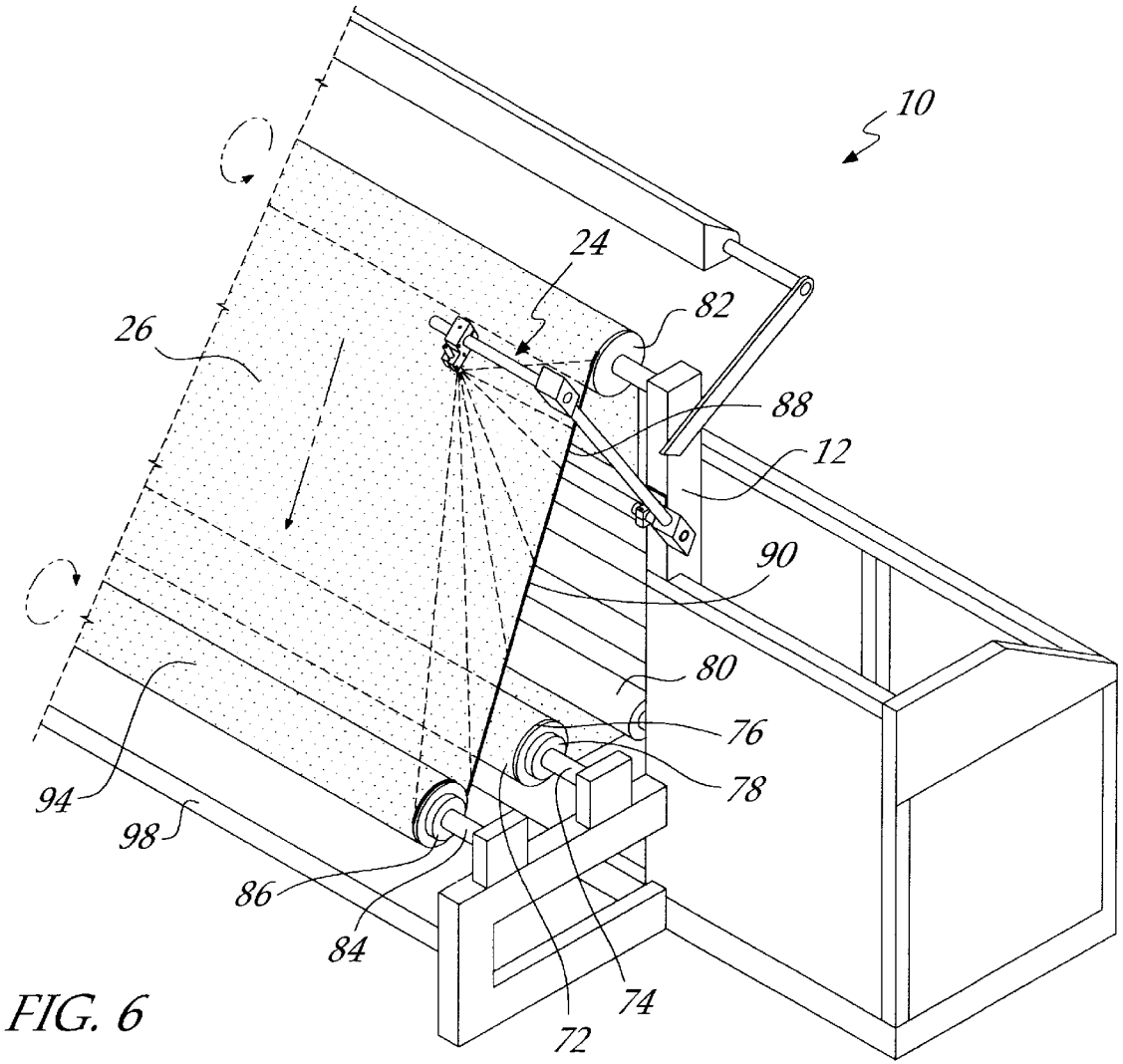
FIG. 6 is a cut-away perspective view of the improved grand format printer depicted in FIG. 2 showing the operation of the web material alignment apparatus of the present invention.

The characteristics and operation of laser assembly 42 may be more clearly described with reference to the portion of the laser assembly 42 depicted in FIG. 5 with front shield 52 removed. Laser line generator 28 is preferably a diode laser requiring low power such as Model No. ULL5-3.5G-635-90 Line Generator Diode Module, manufactured by World Star Technologies, Inc., Toronto, Ont., Canada. This particular laser line generator operates at a wavelength of approximately 635 nm, has a maximum peak radiant power of 3.5 mW, has a fan angle of 90°, a line thickness of less than 1 mm, has an operating voltage of 5 volts, and is classified as a Continuous Wave (CW) class II laser. In a preferred embodiment, laser line generator 28 is housed within an anodized aluminum casing which includes a rotatable adjustment bezel 62. When necessary, adjustment bezel 62 may be rotated by a user to rotate laser line 64 along a central axis 66 passing axially through the center of laser line generator 28. Laser line generator 28 is preferably powered by a conventional power source (not shown) along electric leads 68. Although not shown in the drawing figures, laser line 64 continues beyond the bottom 70 of rear shield 54 to impinge upon the web material during web material alignment as will be described in greater detail below. Moreover, it will be understood by those skilled in the art that although a particular laser line generator 28 has been described in detail above, other types of laser line generators having various other operating characteristics may be used in accordance with the present invention.

In Operation

Generally speaking, web material alignment assembly 24 and laser line generator 28 are calibrated at the factory and laser alignment or reference marks are provided on frame 12 to facilitate assembly and mounting of the web material alignment assembly 24 in the field. With web material alignment assembly 24 properly mounted on frame 12, laser line generator 28 is activated to emit a narrow beam of light which should impinge upon the frame markings indicating that the generated beam is in proper alignment. With the laser line generator 28 active, a supply roll 72 of web material 26 is positioned on a supply roller 74 of web handling assembly 22. Supply roll 72 should be slidably received onto supply roller 74 until a supply roll web material edge 76 is aligned with the laser line projected on supply roller 74. Generally speaking, the supply roll core 78 will extend beyond the web material on supply roll 72 and the laser line. Web material 26 is then extracted from supply roll 72 and passed under a redirect roller 80 over platens 16 and dry heater 18 (FIG. 1), passed back over a directional roller 82 located above the printing area and extended towards a take-up roller 84 located at the rear of improved grand format printer 10. A take-up web material core 86 is typically pre-positioned on take-up roller 84 and web material 26 is preferably positioned on take-up web material core 86 such that web material edge 88 is aligned with laser line 90. Likewise, web material edge 80 may also be aligned with laser line 90 at the location of take-up roller 84. Web material 26 is then fastened to take-up web material core 86, preferably with tape or some other suitable fastener to secure web material 26 to the take-up web material core 86. Thus configured, an operator can easily and immediately visually inspect the loaded web handling assembly 22 to ensure that web material 26 is properly aligned for printing operations. Once properly aligned, printing may begin and web material 26 will be collected to form a take-up roll of web material which can be removed after printing operations are complete.

Web material 26 will generally be cut after one or more print runs to remove the printed web material collected on take-up roll 94 from take-up roller 84. Generally speaking, a new take-up web material core 86 will then be placed on take-up roller 84 and the web material 26 will again be affixed to take-up web material core 86 as described above. Over time, however, web material alignment assembly 24 and/or laser line generator 28 may fall out of alignment. Generally speaking, this will be noted by the operator once printing operations begin by, among other things, the web material not tracking correctly, the web material walking on take-up roll 94, or wrinkling of web material 26.

At this point, printing operations should be terminated and web material alignment assembly 24 should be adjusted to align laser line 90 with the reference points on the frame. To effect this alignment, horizontal support arm 34 should first be checked to ensure that it is level with redirect roller 80. Thereafter adjustment bezel 62 at the end of laser line generator 28 may be rotated to rotate laser line 90 along central axis 66 until laser line 90 is aligned with both reference points. If, however, laser line 90 appears convex or concave rather than linear, an additional adjustment can be made to web material alignment assembly 24. Second mounting block 40 is provided with an adjustment mechanism that enables web material alignment assembly 24 to be pivoted laterally with respect to the path of travel of web material 26 during printing operations. In a preferred embodiment, second mounting block 40 incorporates an adjustment screw 96 that allows the web material alignment assembly 24 to be pivoted to the left or right as required to correct for either a convex or a concave laser line 90. In a preferred embodiment, if the line appears concave, adjustment screw 96 should be loosened. If, however, the line appears convex, the adjustment screw 96 should be tightened so that the proper upright support arm 36 position can be achieved. Either one or both of these operations should be sufficient to bring web material alignment assembly 24 back into proper alignment.

If, however, the above-mentioned operations do not correct the problem, or if web material alignment assembly 24 has not been properly factory calibrated, laser line 90 may be calibrated for alignment by the following method. A level reading of redirect roller 80 is first taken and transferred to horizontal support arm 34 of web material alignment assembly 24 by making the necessary adjustments at the joint between horizontal support arm 34 and upright support arm 36. With laser line generator 28 in the on position, adjustment bezel 62 of laser line generator 28 may then be turned to rotate laser line 90 so that laser line 90 appears to be visually straight and aligned to the operator. A sheet of non-vinyl printer paper having a minimum width of two (2) feet and being of a sufficient length should then be loaded from a take-up web material core 86 positioned on take-up roller 84, under redirect roller 80, over platens 16 and dry heater 18, over directional roller 82 at the top of the printer, and back to the take-up web material core 86 such that the sheet overlaps on the core. While applying even pressure to both ends of the sheet, the overlapped edges of the sheet should be aligned so that the sheet edge will be square in the printer. While continuing to apply pressure to the sheet, the sheet may be taped, paper to paper, at the core in order to make a loop. First mounting block 30 may then be moved laterally along horizontal support arm 34 and adjustment bezel 62 may be rotated with respect to laser line generator 28 so that laser line 90 is as close as possible to parallel with the edge of the sheet. If laser line 90 appears concave or convex, adjustment screw 96 may be loosened or tightened, respectively, to adjust upright support arm 36 so that laser line 90 becomes straight. If laser line 90 is to one side of the sheet edge at redirect roller 80 and on the other side of the sheet edge at take-up roller 84, then adjustment bezel 62 should be rotated to rotate laser line 90 into alignment with the edge. Thereafter, the paper can be removed from the printer and new reference marks can be positioned where laser line 90 impinges on the horizontal material rack brace 98 and the frame member 99 (FIG. 2) below dry heater 18. Following either or both of these procedures should correct any web material 26 alignment problems and permit proper alignment for continued printing operations.

It will be apparent to those skilled in the art that various modifications and variations can be made to the present invention without departing from the spirit and scope of the invention. For example, in a preferred embodiment, web material 26 edge 88 will be aligned with laser line 90 at each of the supply roller 74, redirect roller 80, directional roller 82, and take-up roller 84 during the web material 26 alignment process as discussed above. Thus, it is intended that the present invention cover the modifications and variations of this invention provided that they come within the scope of the appended claims and their equivalents.

What is claimed is:

1. A method of aligning an elongated printable media having an edge on the web handling assembly of a printer, said method comprising the steps of:

projecting an alignment marker onto at least a portion of the web handling assembly;

passing the elongated printable media through the web handling assembly; and aligning the edge of the elongated printable media with said alignment marker such that the edge is substantially co-linear with the alignment marker.

2. The method of claim 1 wherein the web handling assembly includes a supply roller and a take-up roller, and wherein said method includes the step of securing the elongated printable media to the take-up roller such that the edge of the elongated printable media remains substantially co-linear with the alignment marker.

3. The method of claim 2 wherein said projecting step comprises the step of illuminating at least a portion of the web handling assembly with a substantially linear laser beam.

4. The method of claim 1 further comprising an additional step of securing the elongated printable media to the web handling assembly such that the edge remains substantially co-linear with said alignment marker as the elongated printable media is fed through the web handling assembly of the printer.

5. An elongated printable media alignment apparatus for aligning an elongated printable media on the web handling assembly of a printer, said apparatus comprising:

a light source constructed and arranged to project a substantially linear alignment marker onto at least a portion of the web handling assembly; and an adjustable support structure for securing said light source to the printer such that said light source is remote from the printer, said adjustable support structure comprising:

an upright support arm;

a horizontal support arm connected to said upright support arm at a joint;

a first mounting block for movably mounting said light source to said horizontal support arm; and a second mounting block for pivotally connecting said upright support arm to the printer.

6. The apparatus of claim 5 wherein said first mounting block and said second mounting block cooperate to permit horizontal and vertical alignment of the alignment marker.

7. A method of aligning an elongated printable media having an edge on a printer web handling assembly including a supply roller and a take-up roller, said method comprising the steps of:

loading a roll of elongated printable media onto the supply roller;

projecting an alignment marker onto at least a portion of the web handling assembly;

moving the roll of the elongated printable media toward the alignment marker to align the edge of the media with the alignment marker;

extracting the elongated printable media from the roll to pass the elongated printable media through the web handling assembly;

aligning the edge of the elongated printable media with the alignment marker as the elongated printable media is brought into engagement with the take-up roller of the web handling assembly; and securing the elongated printable media to the take-up roller once the edge of the elongated printable media is aligned with said alignment marker.

* * * * *